US005120915A

United States Patent [19]

Doherty

[11] Patent Number: 5,120,915

[45] Date of Patent: Jun. 9, 1992

[54] PRESSURE-ACTUATED PUMP CONTROL SWITCH

[75] Inventor: Robert J. Doherty, Goshen, Ind.

[73] Assignee: Johnson Service Company, Milwaukee, Wis.

[21] Appl. No.: 649,436

[22] Filed: Feb. 1, 1991

[51] Int. Cl.[5] ..... H01H 35/34

[52] U.S. Cl. ..... 200/83 J; 73/723; 200/83 S

[58] Field of Search ..... 91/1; 92/5 R; 307/118; 340/611, 626; 73/717, 723, 745; 200/302.1, 81.4, 81.5, 51 R, 83 R, 83 P, 83 J, 83 S, 83 SA; 361/426

[56] References Cited

U.S. PATENT DOCUMENTS

| | | | |
|---|---|---|---|
| 3,139,493 | 6/1964 | Krieger et al. . | |
| 3,236,963 | 2/1966 | Parmann et al. . | |
| 3,335,241 | 8/1967 | Weber . | |
| 3,340,372 | 9/1967 | Schaefer . | |
| 3,773,991 | 11/1973 | Krieger et al. | 200/83 P |
| 3,875,358 | 4/1975 | Willcox | 200/83 P |
| 3,889,077 | 6/1975 | Hayashi | 200/61.25 |
| 4,054,763 | 10/1977 | Willcox | 200/56 R |
| 4,081,636 | 3/1978 | Rice | 200/83 Y |
| 4,200,775 | 4/1980 | Bodnar | 200/83 S |
| 4,709,126 | 11/1987 | Miller | 200/83 P |
| 4,868,356 | 9/1989 | Lindsey et al. | 200/83 P |
| 4,948,931 | 8/1990 | Nixon et al. | 200/83 P |

*Primary Examiner*—Gerald P. Tolin
*Attorney, Agent, or Firm*—Foley & Lardner

[57] ABSTRACT

A pressure switch according to the invention combines a pressure chamber with diaphragm, plunger, spring-loaded switch mechanism and electrical contacts in a single compact assembly. According to one aspect of the invention, the terminal board of the pump motor is incorporated into the control switch housing, eliminating the need for wiring from the switch to the terminal board and enabling the switch to be mounted inside the wiring compartment of the motor. According to another aspect of the invention, a pair of opposing blades are used in the switch mechanism to eliminate side forces and decrease friction, improving accuracy and life of the switch. A simple set screw may be used with one of the switch blades, in cooperation with a stop associated with the other blade, to adjust the spring force and thereby control the pressure control differential.

15 Claims, 6 Drawing Sheets

PRESSURE-ACTUATED PUMP CONTROL SWITCH

TECHNICAL FIELD

This invention relates to pressure actuated control switches for activating and deactivating an electrical device, and in particular to control switches useful in water pumps and similar devices.

BACKGROUND OF THE INVENTION

Pump pressure control switches have long been used in applications such as home water wells. The switch includes a pressure chamber connected to the pressurized water system, e.g., to the pressure tank connected to the pump. When the pressure falls below a predetermined level, the switch turns the pump on, and turns it off again when a preset maximum pressure is reached. The control differential is the difference in pressure between these two points.

Known pump control switches are generally mounted in one of two ways. In one, the control is mounted directly to the tank, and a cord or electrical conduit and wiring are then run to the pump motor's wiring compartment. In the other, the control switch is mounted to the outside of the motor's wiring compartment, and the pressure connection to the water system is made via a hose or tubing, with electrical wiring run through the mounting connector.

Known pump controls generally include a pressure chamber wherein a diaphragm moves in response to changes in pressure. A spring-loaded switch mechanism including an actuator connected to the diaphragm causes the switch to bridge the electrical contacts at the predetermined minimum pressure. See Lindsey et al., U.S. Pat. No. 4,868,356, issued Sep. 19, 1989, Bodnar, U.S. Pat. No. 4,200,775, issued Apr. 29, 1980, Rice, U.S. Pat. No. 4,081,636, issued Mar. 28, 1978, Willcox, U.S. Pat. No. 4,054,763, issued Oct. 18, 1977, Willcox, U.S. Pat. No. 3,875,358, issued Apr. 1, 1975, Krieger et al., U.S. Pat. No. 3,773,991, issued Nov. 20, 1973, Weber, U.S. Pat. No. 3,335,241, issued Aug. 8, 1967, Parmann et al., U.S. Pat. No. 3,236,963, issued Feb. 22, 1966, and Krieger, Sr., et al., U.S. Pat. No. 3,139,493, issued Jun. 30, 1964. Miller U.S. Pat. No. 4,709,126, issued Nov. 24, 1987, describes a pressure switch wherein a pair of leaves pivot in V-shaped grooves of an output element under the action of a spring holding the leaves to the output element.

A variety of mechanisms for such devices are known, but each suffers from various disadvantages. Some are large, cumbersome devices with a large pressure chamber, spring, etc. See, for example, U.S. Pat. No. 3,340,372. Others lack the capacity to operate large devices. All require secondary wiring from the switch to the terminal board of the pump motor.

The present invention provides a pressure switch that addresses these disadvantages.

SUMMARY OF THE INVENTION

A pressure switch according to the invention combines a pressure chamber with diaphragm, actuator, spring-loaded switch mechanism and electrical contacts in a single compact assembly. According to one aspect of the invention, the terminal board of the pump motor is incorporated into the control switch housing, eliminating the need for wiring from the switch to the terminal board and enabling the switch to be mounted inside the wiring compartment of the motor.

According to another aspect of the invention, a pair of opposing blades are used in the switch mechanism to eliminate side forces and decrease friction, improving accuracy and life of the switch. A simple set screw may be used with one of the switch blades, in cooperation with a stop associated with the other blade, to adjust the switch travel and thereby adjust the pressure control differential.

Other objects, features and advantages of the invention will become apparent from the following detailed description. It should be understood, however, that the detailed description and the specific examples, while indicating preferred embodiments of the invention, are given by way of illustration only, since various changes and modifications within the spirit and scope of the invention will become apparent to those skilled in the art.

BRIEF DESCRIPTION OF THE DRAWINGS

The invention will be further described with reference to the accompanying drawings, wherein like numerals denote like elements, and:

FIGS. 7A–7F are a series of cross-sectional views of the switch shown in FIG. 2, showing the switch mechanism is a series of positions during operation.

DETAILED DESCRIPTION

Figure 1:
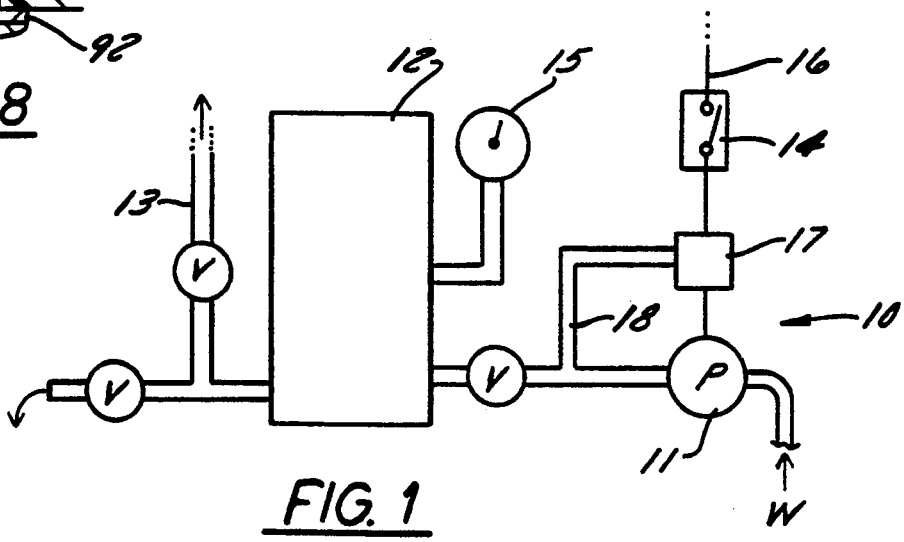
FIG. 1 is a schematic diagram of a water pump system according to the invention.

Referring to FIG. 1, an exemplary water pump system 10 according to the invention includes a jet pump 11 which draws water from a well W, a pressure tank 12 which holds water from pump 11, a plumbing system 13 which distributes pressurized water to the house, a pump on-off switch 14 connected to a source of electrical power, e.g. a household circuit 16, and a pump control pressure switch 17 of the invention. Switch 17 is coupled to pump 11 by a line (pipe, hose or tube) 18 so that it can sense the system pressure. Switch 17 also forms part of circuit 16 so that pump 11 is activated intermittently in response to drops in pressure in tank 12.

Figure 2:
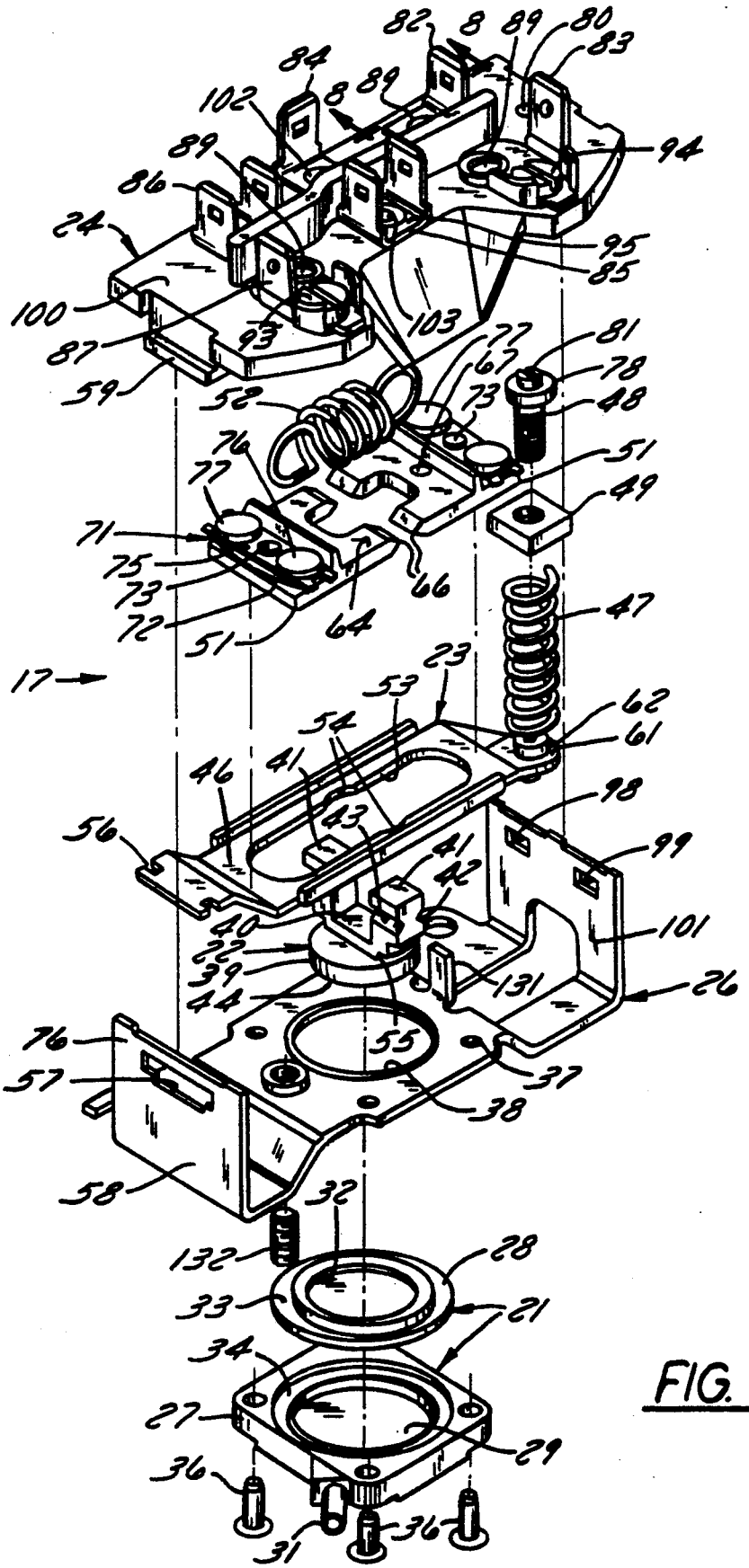
FIG. 2 is an exploded view of the switch of the invention.

Referring now to FIG. 2, switch 17 comprises a pressure chamber assembly 21, an actuator (plunger or point) 22, a spring-loaded switch mechanism 23 and a terminal board 24, all secured to a metal base 26. Pressure chamber assembly 21 includes a pressure cup 27 made of suitable plastics, such as nylon or polypropylene, and a rubber diaphragm 28. Cup 27 has a central round recess 29 which is connected to line 18 by an inlet 31. Diaphragm 28 has a central, round, flexible membrane portion 32 which fits over recess 29 to form the pressure chamber 30. The outer portion of diaphragm 28 has a seal bead 33 on its periphery. A ring-shaped groove 34 on the upper face of cup 27 accepts seal bead 33 for locating diaphragm 28 and sealing the edge of the pressure chamber. Diaphragm 28 is clamped between cup 27 and base 26 by sonic welding of plastic posts 36 to form a retaining head on each post, or by any other suitable means, such as rivets, screws or other fasteners. The outside of membrane 32 is exposed by round opening 38.

Plunger 22 comprises a unitary plastic disk 39 having a central projection 40 on the upper face thereof which diverges to form a pair of upwardly extending, Y-shaped arms 41. Each arm 41 has a pair of diametrically opposed, sidewardly-opening notches 42, 43 therein which give the upper ends of arms 41 an hourglass shape in side profile. Disk 39 extends through opening 38 so that a flat bottom face 44 of disk 39 engages the outside of membrane 32 (see FIGS. 7A–7F).

Switch mechanism 23 includes a lever 46, main spring 47, a set point adjustment screw 48 with nut 49, a pair of opposing switch blades 51, and a switch spring 52. Lever 46 has an elongated central slot 53 through which arms 41 fit during assembly so that projection 40 is secured in slot 53 with the aid of notches 54 therein. A pair of diametrically opposed corners 55 on the sides of projection 40 fit within opposed notches 54 in the sides of slot 53 to provide a quarter-turn self-locking action. Plunger 22 is thereby secured for movement in unison with lever 46.

Lever 46 has a notched tab 56 at one end thereof which interlocks with an associated opening 57 in an end wall 58 of base 26. A plastic clip arm 59 extending from the underside of terminal board 24 fits into opening 57 above tab 56 and secures it therein (FIGS. 7A–7F), leaving lever 46 able to pivot slightly from tab 56. The end of lever 46 remote from tab 56 comprises a projection 61 having suitable means thereon for retaining the end of main spring 47, such as a round boss 62 or a pin, recess, or the like.

Figure 7A:
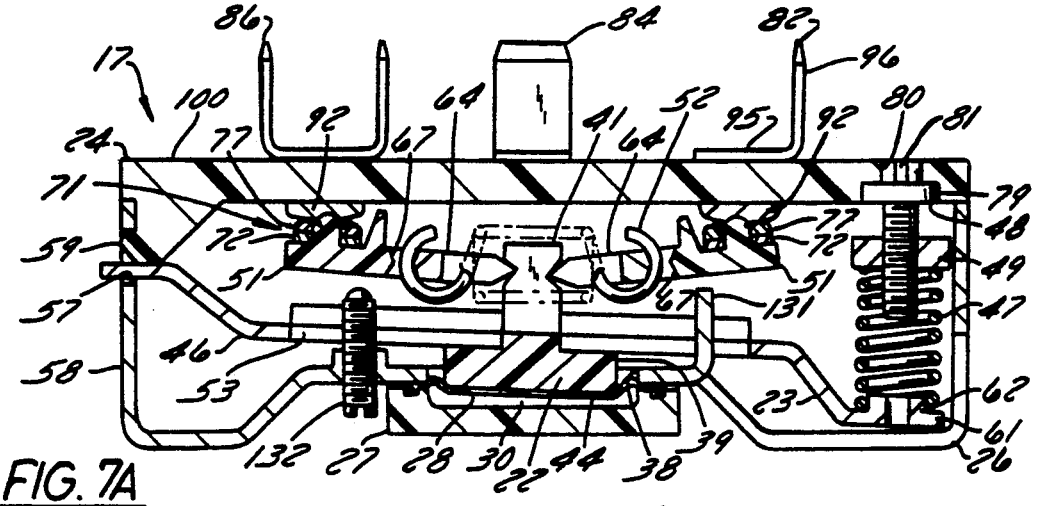

Switch blades 51 each comprise a generally U-shaped plastic member having a pair of parallel arms 64 which taper to thin straight edges 66. As shown in FIG. 7A, edges 66 engage corresponding bottoms of notches 42 in plunger 22. The ends of arms 64 taper more steeply than the corresponding walls of notches 42, permitting blades 51 to pivot against plunger 22 as described below. The knife-edge pivoting action provided by the foregoing construction improves the switch snap, or opening and closing rate, and reduces hinge friction. The ends of coil spring 52 are mounted in respective holes 67 in each of blades 51 to bias each blade 51 against plunger 22. Spring 52 extends between arms 41, as shown in FIG. 7A.

A contact assembly 71 is mounted on the respective outer, upper faces of each blade 51. Contact assembly 71 is comprised of a conductive plate 75 and two conductive contact buttons 76,77. Contact buttons 76,77 are secured at opposite ends of plate 75 by any suitable means, such as soldering, welding, staking or fasteners. Interposed between each contact assembly 71 and each blade 51 is a leaf spring 72. Both leaf spring 72 and contact assembly 71 are secured to plate 51 by a pin 73. Contact assembly 71 is fitted to pin 73 such that contact assembly 71 can move freely on pin 73 but is restrained by a head on pin 73, or by a clip or other mechanical fastener. The pin 73 may be either a separate part or an integral part of blade 51. As contact assembly 71 moves on pin 73, it compresses leaf spring 72 against the upper face of blade 51. Leaf spring 72 is designed so that the upward force that leaf spring 72 applies on contact assembly 71 when leaf spring 72 is completely flattened against blade 51 is equal to the minimum desired contact closure force for the switch. In the alternative, leaf spring 72 may itself conduct electrical current from contact 76 to contact 77, and plate 75 may be omitted.

Referring to FIGS. 2 and 7A, main spring 47 is secured against lever 46 by set screw 48 and nut 49. Nut 49 is mounted at a predetermined position on the threaded body of screw 48. The upper end of spring 47 abuts against nut 49, so that spring 47 is confined for compression between the end of lever 46 and nut 49. The head 78 of screw 48 is received in a mating recess 79 on the underside of terminal board 24, and the slot 81 therein for adjustment using a screwdriver is accessible from above by means of a hole 80 in terminal board 24.

Figure 5:
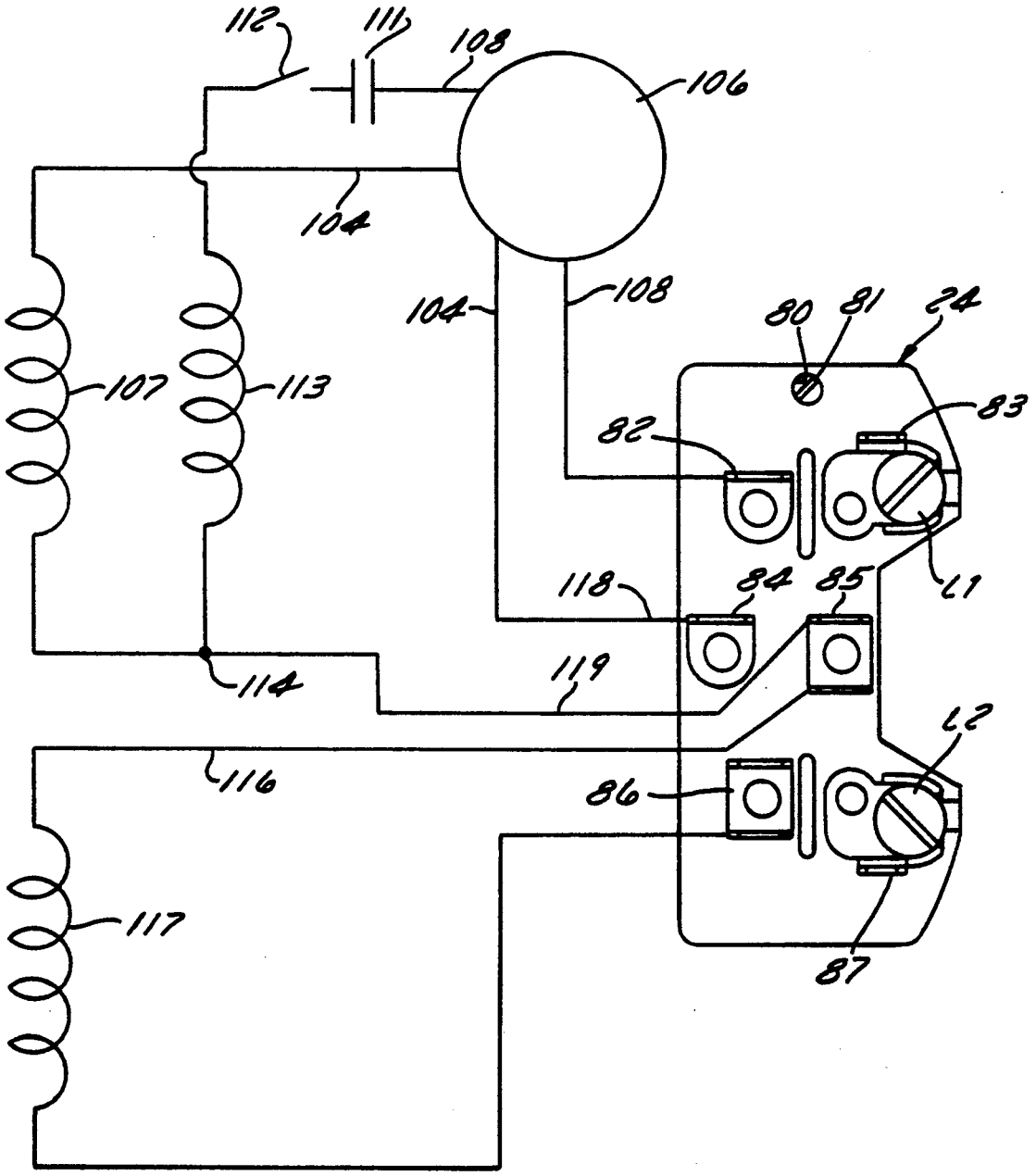
FIG. 5 is an electrical schematic diagram of the system shown in FIG. 1.

Referring to FIGS. 2 through 5, the upper side of terminal board 24 has a series of terminals 82–87 for connection to either a high (230 volt) or low (115 volt) circuit. Each of terminals 82–87 includes one or more upright posts or tabs 90 suitable for installation of quick-connecting electrical connectors, such that each terminal 82–87 is L- or U-shaped and has a flange 95 with a hole therein for connection to a board portion 100 of terminal board 24 by a conductive fastener, such as a copper rivet. Board 100 is made of any suitable stiff, electrically insulating material, such as rubber or plastic. Terminals 83 and 87 further include respective screw mountings 93, 94 for releasably securing a pair of power lines L1 and L2 (FIG. 5).

Figure 3:
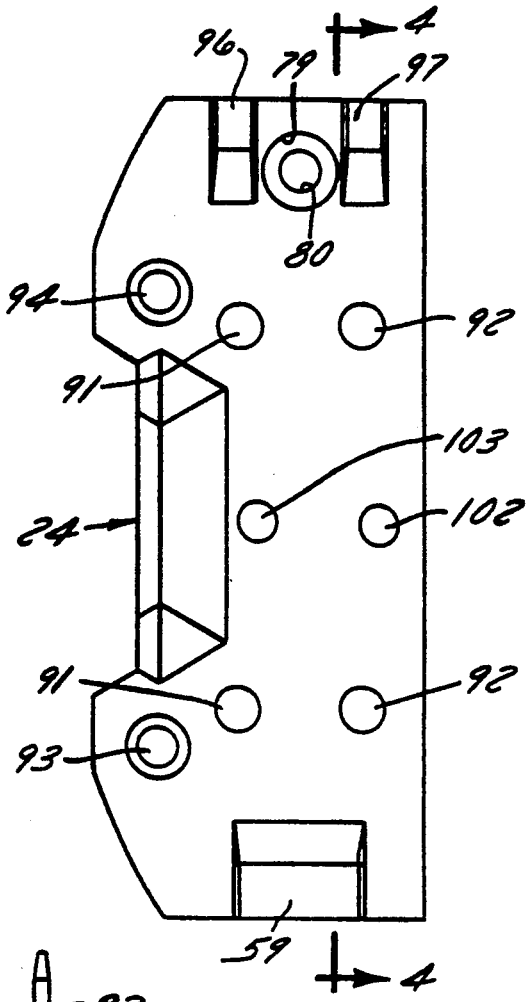
FIG. 3 is an bottom plan view of the terminal board shown in FIG. 2.
Figure 4:
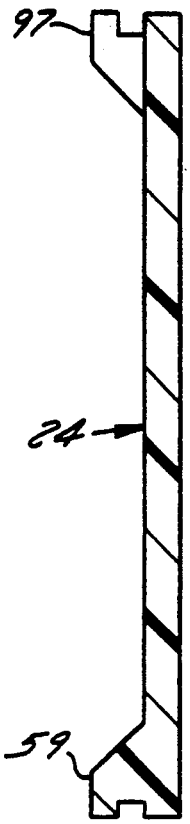
FIG. 4 is a lengthwise sectional view along the line 4—4 in FIG. 3 with terminal hardware removed.
Figure 8:
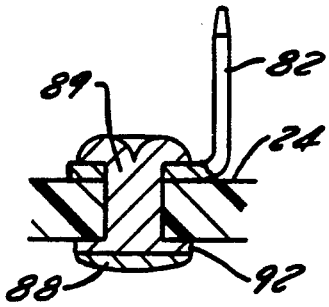
FIG. 8 is a partial sectional view taken along the line 8—8 in FIG. 2.

Referring to FIGS. 2, 3 and 8, two pairs of contact buttons 91, 92 disposed on the underside of board 24 are positioned to engage buttons 76, 77 when blades 51 pivot upwardly, thereby establishing electrical contact between terminals 82, 83 and 86, 87, respectively. Buttons 91,92 are connected to terminals 83, 82 and 87, 86, respectively, by any suitable means, such as conductive rivets 89 or similar connectors extending through board 24 from button 76 or 77 to the flange 95 of the associated terminal. In a preferred embodiment, buttons 91,92 include surface cladding layers 88 having good conductivity and wear characteristics (e.g., 90% silver, 10% cadmium oxide) formed on the head of copper rivet 89, which is then secured in a hole through the flange 95, as shown in FIG. 2.

Terminal board 24 is secured to base 26 by clip arm 59, as noted above, and also by a pair of additional clip arms 96, 97 on opposite sides of recess 79 (FIG. 4) which engage a pair of openings 98, 99 in a side wall 101 of base 26 opposite side wall 58. As shown in FIG. 3, rivets 102, 103 secure the intermediate terminals 84, 85 to board 24.

FIG. 5 illustrates a high voltage layout of electrical connections for terminal board 24. Wiring 104 connects terminal 84 in series to an overload protector 106, main motor coil 107 and terminal 85. Further wiring 108 connects terminal 82 in series to overload protector 106, a capacitor 111, a motor starter switch 112, and a motor starting coil 113 having out-of-phase windings, terminating at a junction 114 with wiring 104. Additional wiring 116 connects terminal 85 in series with a second main motor coil 117 and ends at terminal 86. For a low voltage connection, a first lead 118 of wiring 104 is moved from terminal 84 to terminal 85, and a second lead 119 of wiring 108 is moved from terminal 85 to terminal 86. In this manner the pressure switch of the invention can be adapted to either high or low voltage applications.

Figure 6:
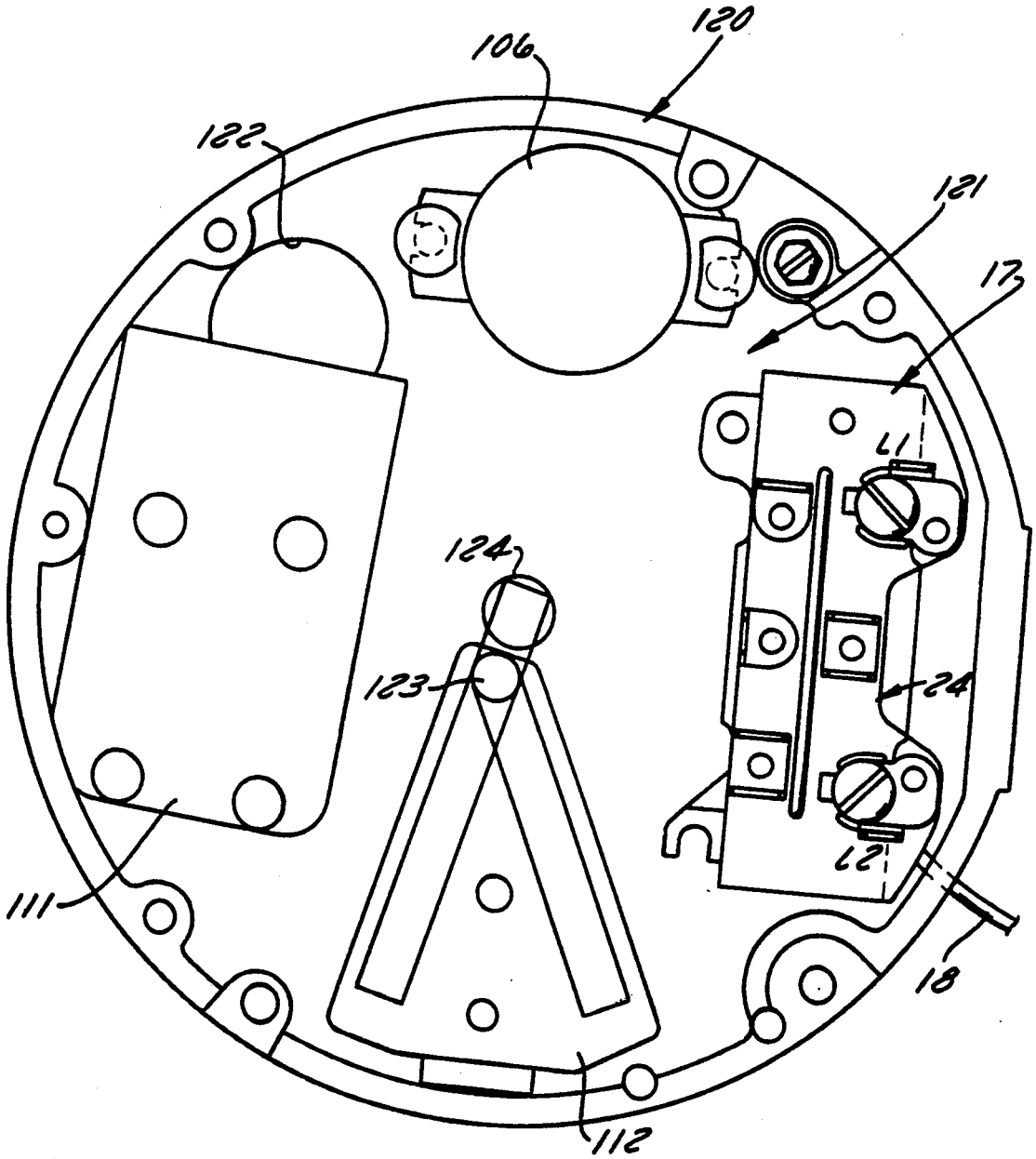
FIG. 6 is an end view of a pump motor wiring compartment in which the switch of FIG. 2 is installed.

Referring now to FIG. 6, pressure switch 17 is shown fitted into a wiring compartment 121 of the pump motor 120 (wires omitted). The small size of switch 17 permits it to fit into this space, eliminate the need to mount it externally. The pressure line 18 may comprise a small hose 18 that enters the wiring compartment 121 through its side, as shown. Compartment 121 is otherwise of conventional design, and includes therein the overload protector 106, an opening 122, capacitor 111, and start switch 112 connected to an actuator 123.

OPERATION

FIGS. 7A through 7F illustrate the different positions switch 17 assumes during operation. FIG. 7A illustrates that state of switch mechanism 23 at a low pressure when the pump 11 is running. Contacts 76, 77 are closed with contacts 91, 92, respectively. The centerline of switch mechanism 23 is above the pivot point, i.e., the position at which blades 51 pivot from their upwardly tilted positions and tilt downwardly, or the reverse. In this position, spring 52 provides a moment to blades 51 and thereby a sufficient contact force is applied to contacts 76, 77 and 91, 92. When blades 51 are in this position, this contact force exceeds the force needed to compress leaf springs 72, and leaf springs 72 are completely flattened against the upper surface of switch blades 51.

Figure 7B:
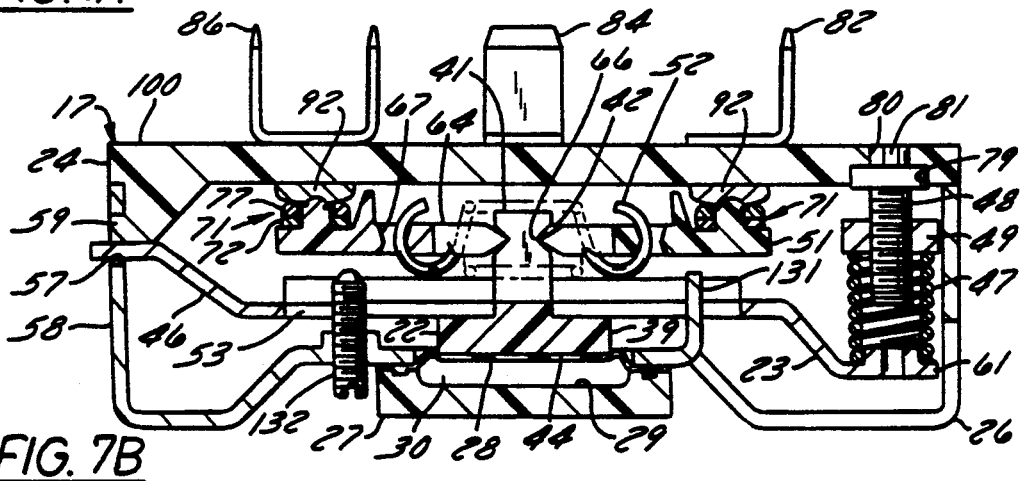
Figure 7C:
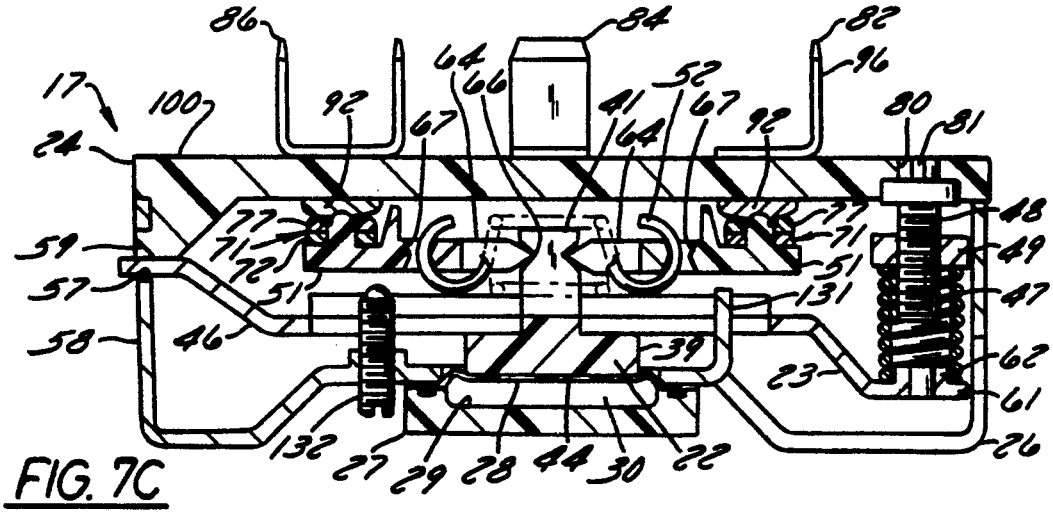

Referring now to FIG. 7B, as the pressure in chamber 30 increases, plunger 22 is pushed upwardly, lever 46 pivots, and main spring 47 is compressed. As plunger 22 rises, the angle of blades 51 becomes smaller (more nearly horizontal), reducing the moment produced by switch spring 52. When the contact force, which provides the balancing moment against switch spring 52, fails to equal the force required to compress leaf springs 72, the switch mechanism 23 begins to trip. This allows the switch to trip while there is still adequate contact force.

Leaf springs 72 and switch spring 52 are configured so that the rate at which the moment created by switch spring 52 is reduced exceeds the rate at which leaf springs 72 expand. This causes lever 46 to continue to pivot without any further increase in pressure or movement of plunger 22. At the point where the centerline of the switch spring 52 is even with the pivot point (FIG. 7C), leaf springs 72 are still partially compressed, assuring that switch mechanism 23 will follow through on its motion.

Figure 7D:
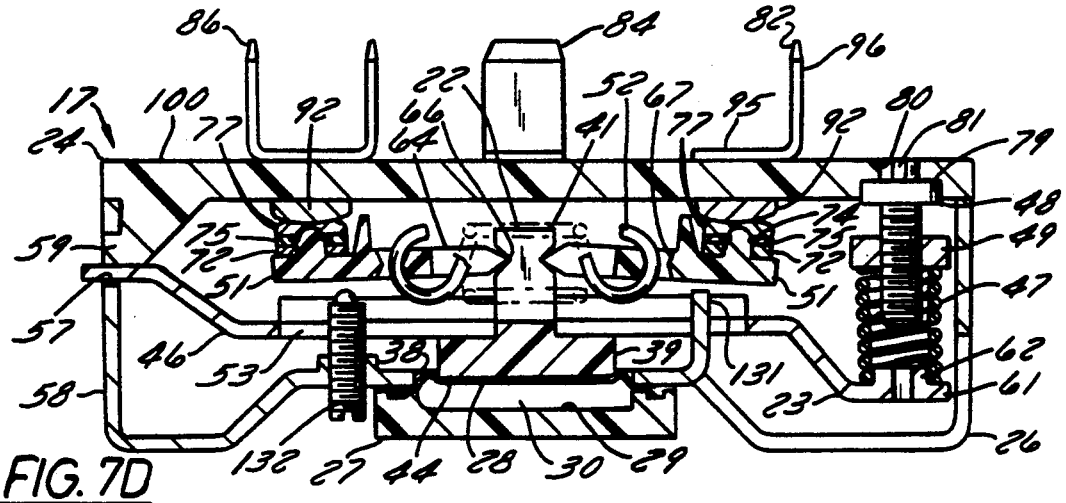
Figure 7E:
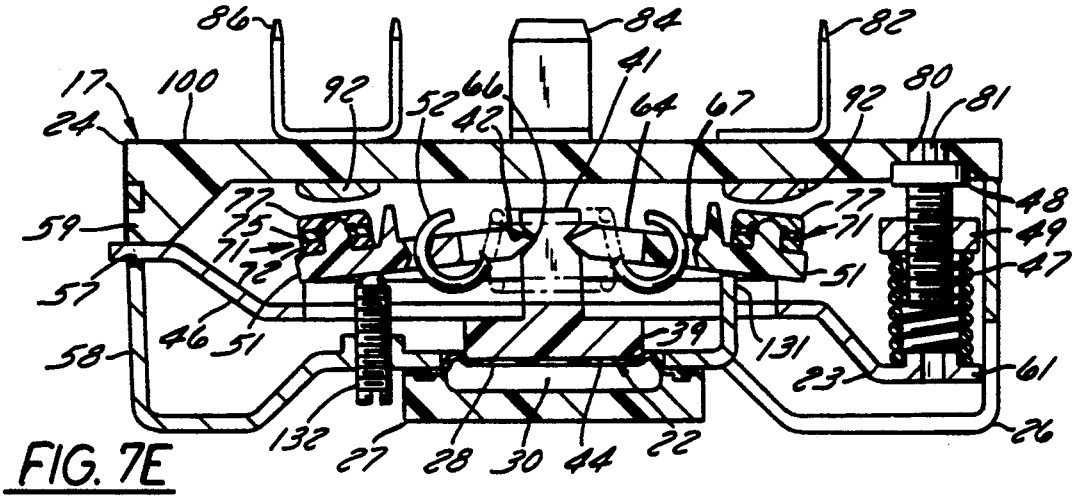
Figure 7E:
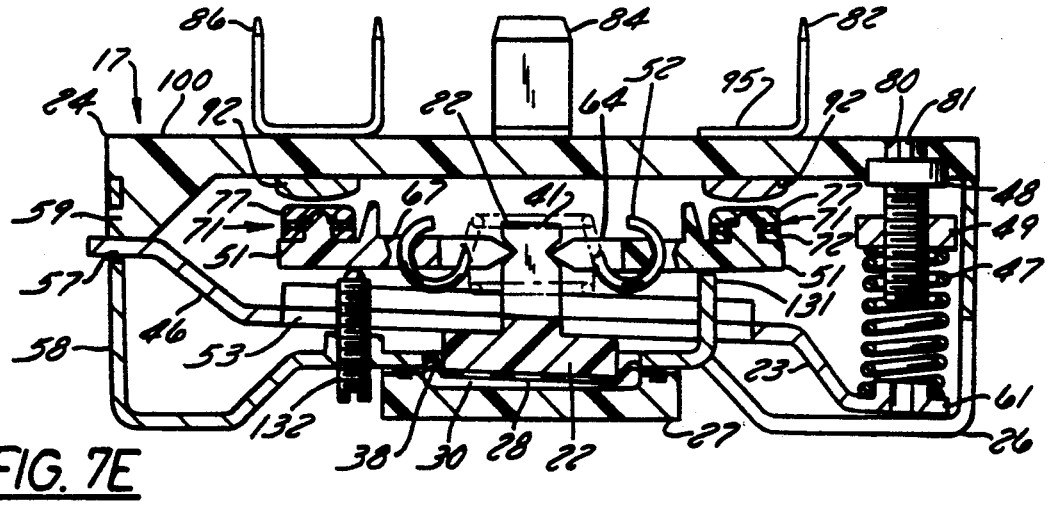

Referring to FIG. 7D, leaf springs 72 continue to expand until plates 75 contact clips 74 on posts 73. Blades 51 now tilt slightly downwardly. The centerline of switch spring 52 is now sufficiently far below the pivot point to break the contacts. Blades 51 continue to rotate until the right blade 51 contacts an upright stop 131 formed as a bent tab on base 26, and the left blade 51 contacts an optional adjustment screw 132 mounted on the opposite side of base 26 from stop 131. Changing the blade stop position by means of adjustment screw 132 changes the angle at which blades 51 line up with the centerline of switch spring 52, allowing fine adjustments in reset position. When blades 51 reach the position shown in FIG. 7E, the switch snap motion is completed and contact between contacts 76, 77 and 91, 92 is broken. The snap occurs before the force between contacts 76, 77 and 91, 92 drops to zero, thereby preventing burning of the contacts.

Referring to FIG. 7F, when pump switch 17 is open, pump 11 stops running and the pressure in chamber 30 decreases. As this happens, main spring 47 pushes lever 46 and plunger 22 down. Blades 51 rotate until the centerline of switch spring 52 again passes the pivot point. This causes blades 51 to pivot upward, closing contacts 76, 77 and 91, 92 once more and restarting the pump cycle.

It will be understood that the foregoing description is of preferred exemplary embodiments of the invention, and that the invention is not limited to the specific forms shown. For example, while the switch of the invention has been described as controlling a pump, it could also be used to control a compressor or any other similar electrical device which is controlled by feedback based on changes in pressure. This and other modifications may be made in the design and arrangement of the elements without departing from the scope of the invention as expressed in the appended claims.

I claim:

1. A pressure switch, comprising:

a base;

a pressure chamber assembly secured to said base, including a diaphragm which moves in response to changes in pressure within a chamber and an inlet for admitting a pressure fluid to said chamber;

a plunger in abutment with said diaphragm for movement therewith;

a terminal board secured to said base, including an electrically insulating board, first, second and third pairs of terminals mounted on an outer surface of said insulating board, first electrical contacts mounted on an inner surface of said insulating board and electrically connected to said first pair of terminals, second electrical contacts mounted on an inner surface of said insulating board and electrically connected to said third pair of terminals; and a switch mechanism mounted on said base and disposed to open and close by establishing and interrupting electrical contact between said first and second pairs of contacts in response to movement of said plunger.

2. The pressure switch of claim 1, wherein said terminals comprise upright conductive posts and means for securing said posts to said terminal board.

3. The pressure switch of claim 2, wherein said securing means comprises rivets.

4. The pressure switch of claim 2, wherein said contacts comprise conductive buttons disposed on the underside of said board, and said securing means is electrically conductive and connects said buttons to the associated terminal posts.

5. The switch of claim 4, wherein the securing means comprise rivets, and each of said buttons comprise a cladding layer on the head of an associated rivet.

6. The switch of claim 1, wherein said plunger comprises a disk portion which abuts said diaphragm and a projection which extends therefrom, said projection having a pair of diverging notches formed on opposite sides thereof, which notches taper inwardly to form a pivot point; and wherein said switch mechanism includes a lever engaged for movement with said plunger and pivotally mounted to said base at one end of said lever, a main spring which biases said lever and said plunger against said diaphragm, a pair of opposed switch blades having tapered inner edges which pivotally engage said notches on opposite sides of said plunger, a pair of contacts disposed proximate the outer end of each switch blade, an electrical connector spanning said pair of contacts, means for securing said connector and contacts to each respective switch blade, means for retaining said main spring on the end of said lever opposite said pivotally mounted end, a switch spring mounted on said switch blades which biases said switch blades against said plunger for pivoting about the pivot point; and wherein said first and second contacts of said terminal board engage the contacts of each switch blade, respectively, upon pivoting of said blades against said plunger to a closed position as said plunger moves in response to movement of said diaphragm due to decreased pressure in said pressure chamber.

7. A pressure switch, comprising:

a housing;

a pressure chamber assembly secured to said housing, including a diaphragm which moves in response to changes in pressure within a chamber and an inlet for admitting a pressure fluid to said chamber;

a plunger in abutment with said diaphragm for movement therewith, including a pair of diverging notches formed on opposite sides of said plunger, which notches form a pivot point;

a switch mechanism including a lever engaged for movement with said plunger and pivotally mounted to said housing at one end of said lever, a main spring which biases said lever and said plunger against said diaphragm, a pair of opposed switch blades having inner ends which pivotally engage said notches on opposite sides of said plunger, a pair of contacts disposed proximate the outer end of each switch blade, an electrical connector spanning said pair of contacts, means for securing said connector and contacts to each respective switch blade, means for retaining said main spring on the end of said lever opposite said pivotally mounted end, and a switch spring mounted on said switch blades which biases said switch blades against said plunger for pivoting about the pivot point; and pairs of terminals secured to said housing and disposed to engage the contacts of each switch blade, respectively, upon pivoting of said blades against said plunger to a closed position as said plunger moves in response to movement of said diaphragm due to a change in pressure in said pressure chamber.

8. The pressure switch of claim 7, further comprising means for movably mounting said contacts to each of said switch blades, and means for resiliently biasing said contacts in an extended position towards said terminals.

9. The pressure switch of claim 8, wherein said means for biasing each of said contacts comprises a leaf spring mounted on each of said switch blades.

10. The pressure switch of claim 9, wherein said switch assembly further comprises a conductive plate interposed between said contacts and said leaf spring, and means for securing said contacts to said plate.

11. The pressure switch of claim 7, wherein the inner ends of said switch blades taper to an edge at an included angle smaller than the angle at which said notches diverge.

12. The pressure switch of claim 7, wherein said switch mechanism further comprises an adjustable stop mounted on said housing beneath one of said switch blades.

13. The pressure switch of claim 1, wherein said second pair of terminals lack corresponding contacts on the inner surface of said terminal board.

14. The pressure switch of claim 13, wherein said second pair of terminals are located between the first and third pairs of terminals.

15. The pressure switch of claim 1, wherein said base and said terminal board fit together to form a housing for said pressure switch.

* * * * *